United States Patent [19]

Burke

[11] Patent Number: 4,874,916

[45] Date of Patent: Oct. 17, 1989

[54] INDUCTION HEATING AND MELTING SYSTEMS HAVING IMPROVED INDUCTION COILS

[75] Inventor: Patrick E. Burke, North York, Canada

[73] Assignee: Guthrie Canadian Investments Limited, Scarborough, Canada

[21] Appl. No.: 127,537

[22] Filed: Nov. 30, 1987

Related U.S. Application Data

[63] Continuation-in-part of Ser. No. 875,884, Jun. 13, 1986, abandoned.

[30] Foreign Application Priority Data

Jan. 17, 1986 [CA] Canada ..... 499813

[51] Int. Cl.[4] ..... H05B 6/42

[52] U.S. Cl. ..... 219/10.75; 219/10.491; 219/10.79; 336/62; 336/186; 336/225

[58] Field of Search ..... 219/10.79, 10.43, 10.75, 219/10.71, 10.491, 10.77; 336/60, 61, 62, 82, 186, 188, 205, 222, 223, 224

[56] References Cited

U.S. PATENT DOCUMENTS

| | | | |
|---|---|---|---|
| 1,986,353 | 1/1935 | Northrup | 219/10.79 X |
| 2,457,179 | 12/1948 | Rossy | 219/10.79 |
| 2,479,341 | 8/1949 | Gehr et al. | 219/10.79 |
| 2,747,068 | 5/1956 | Lackner | 219/10.79 X |
| 2,788,426 | 4/1957 | Thompson | 219/10.79 X |
| 2,792,482 | 5/1957 | Logan et al. | 219/10.71 |
| 3,256,417 | 6/1966 | Merrett | 219/10.79 |
| 3,260,792 | 7/1966 | Kreisel | 219/10.79 X |
| 3,264,590 | 8/1966 | Trench | 336/60 |
| 4,392,040 | 7/1983 | Rand et al. | 219/10.491 |
| 4,532,398 | 7/1985 | Henriksson | 219/10.79 |

*Primary Examiner*—Philip H. Leung

[57] ABSTRACT

Improved electric induction heating apparatus wherein the coil has two or more windings of special low loss conductor with such windings electrically connected in parallel. The two or more windings can be wound simultaneously one on top of the other and/or disposed radially one outside of the other. The coil windings embedded in a rigid set resinous material thus providing a rigid cylindrical unit. At least one of the coil windings has the low loss conductor around a tube the latter providing a fluid flow path for circulatig cooling fluid therethrough by at least one of current balancing transformers, transposition of the windings, and appropriately choosing the number of turns of each coil layer. A split ring bus can be used at the ends of the coils to connect the windings in parallel and laminated steel yokes can be disposed about the coil. There is also disclosed an improved inductive coil assembly for electric inductive heating apparatus comprising a cylindrical winding embedded in a temperature resistant non-magnetic material such as glass fibre reinforced resin and a heat sink rigid unit removably disposed within such coil unit. The heat sink unit comprises conduit means embedded in a temperature resistant material and providing a fluid flow passage for circulating a cooling fluid therethrough. The heat sink is removably inserted in the inductive coil unit. The helical winding is wound from a liquid cooled low loss conductor.

46 Claims, 10 Drawing Sheets

INDUCTION HEATING AND MELTING SYSTEMS HAVING IMPROVED INDUCTION COILS

This is a continuation in part of application Ser. No. 875,884 filed June 13, 1986

FIELD OF INVENTION

This invention relates to improvements in induction heating and melting systems and more particularly to improvements in the inductive coil in such systems.

With recent progress in the electronics of power control, induction heating has become an important technique in such applications as melting, reheating before forming and localized heat treatment. Some areas still remain, however, where induction heating has not seen the same development because of inadequate or poorly performing equipment, lack of experience, or unexpressed requirements.

Today, induction heating has seen important progress in the development of new electrical power supplies, especially static power converters. On the other hand, the heating inductor has remained the classic coil assembly and has seen no improvements in its design.

BACKGROUND OF INVENTION

The coils or inductors in induction heating are required to produce alternating magnetic fields of very large intensities (in the range 80,000 to 300,000 amperes turns per metre). In the present state of the art almost all induction heating coils are made of hollow copper conductors, which are wound into a single layer solenoidal coil. Because the coil consists of only a single layer of rather large conductor, the number of turns must be small and therefore the current in each turn must be very high to achieve the field intensities required. This gives rise to very large $I^2R$ losses in the reactor and therefore the efficiency with which energy is transferred from the coil to the billet being heated is low (typically in the range of 30 to 70 percent depending upon the material being heated and the frequency being used). The addition of a second layer of hollow conductors forming a second solenoid concentric with the first and connected in series with it, allows the current in the coil to be reduced to nearly half of its normal value and still maintain the same field intensity at the billet inside the coil. This has the effect of reducing the $I^2R$ losses in the coil but, unfortunately, the inner layer of hollow copper conductors is heated by the induced currents caused by the field of the outer layer and the resulting losses in the coil are substantially the same as though a single layer coil were used. The addition of even more layers can in fact make the resulting total coil loss larger than it would be for the single layer coil which produces the same magnetic field intensity.

It has long been the goal of induction heating designers to increase the efficiency of their installations and a specific goal has been to devise a method of using multiple layers in a coil to achieve this end. One solution has been described by I. A. Harvey in a paper entitled "a method of improving the energy transfer in induction heating process and its application in a 1 MW billet heater", published in 1977 in IEE Conference Publication 149: Electricity for Materials Processing and Conservation pp. 16–20. The method utilizes a disc wound transformer type coil made from strip type conductors arranged so that the strips are thin in the radial direction and long in the axial direction of the coil and the whole assembly is immersed in water for cooling. This has the effect of reducing the eddy losses near the mid-plane of the coil, where the flux is axial and faces the thin side of the strips but it does not reduce the losses near the end of the coils where a significant portion of the magnetic field is radial. Coils of this construction perform reasonably well at low frequencies but perform very poorly at moderate and high frequencies where the eddy losses are still very substantial. A further disadvantage is the necessity to place all of the conductors in series giving rise to a very high coil voltage. This is particularly troublesome since the insulated coil is immersed in water.

Another proposal was presented in a paper presented at the Electroheat Congress in Stockholm in June 1980 entitled "Technical Innovation in the Induction Reheating of Billets Wires and Strips", by M. Coevet, J. Heurten, J. Nun and E. Poirout, which discloses an induction heating coil wound using a rectangular conductor which comprises 18 transposed insulated subconductors, 12 of which are thin strips and 6 of which are hollow rectangular copper conductors, the latter being interleaved with the former to cool the conductor. The authors claim an improvement in efficiency when heating aluminum at 50 Hz of 12% (from 42 to 54%) and point out that the use of this special conductor is limited to 400 Hz.

SUMMARY OF INVENTION

A principal object of the present invention is to provide an increase in the efficiency of induction heating systems by providing an inductor arrangement that reduces electrical losses.

The foregoing object is accomplished through one or more of several different features of applicant's invention, one of which is the use of low loss conductors for the coil winding. The reference "low loss" has special meaning in this application as will become apparent hereinafter. The conductor itself preferably is of applicant's novel design and the arrangment is such that both throughput current losses and eddy losses may be controlled in an arbitrary way. A further feature is the use of multiple winding coils with the windings connected in parallel and means provided whereby the current distribution in the windings is maintained at a pre-determined value despite changes in the frequency of the coil supply, despite the changes in load introduced into the coil and in the presence of magnetic yokes surrounding the coil. In power intensive systems the conductor is hollow and a cooling fluid is circulated through to dissipate the generated heat and/or a heat sink winding is provided between the refractory and the inductive coil for the same purpose. In applicant's system, the voltage between adjacent conductors is reduced to a small fraction of its normal value by means of voltage grading.

In accordance with one aspect of the present invention, there is provided in electric inductive heating apparatus an improved inductive coil comprising a rigid coil unit having two or more helices of insulated conductors embedded in a temperature resistant non-magnetic material such as a fibre reinforced resin, means connecting said helically wound conductors in parallel and means automatically to force said conductors to share in selected predetermined proportions current flow therethrough including during variations of load and/or frequency.

An induction heating device provided in accordance with the present invention comprises a cylindrical coil made from a special low-loss, multiple path transposed conductor wound spirally around a tube through which a cooling fluid can be circulated. Individual coil windings can if desired be either (a) interleaved in a single layer or (b) coaxially disposed providing a number of layers or (c) a combination of (a) and (b) above. The individual coil windings in such arrangements are connected in parallel and sharing of current among the individual paralleled coil windings is, in a preferred embodiment, controlled by an automatic current balancing scheme which maintains the pre-determined current division automatically despite changes in the frequency of the supply to the induction heating device, despite changes in the load inside the device, and despite the presence of yokes, if used. The induction heating device may or may not contain a multi-arm spider type connecting bus at one end connecting the layers of coils in parallel.

In accordance with a further aspect of the present invention, there is provided in inductive heating apparatus an improved inductive coil self supporting assembly comprising anelongate open-ended tubular rigid inductive coil unit having at least one helical winding embedded in a temperature resistant non-magnetic material such as fibre reinforced resin and a heat resistant rigid heat shield unit removably disposed within said coil unit, said heat shield unti comprising conduit means embedded in a temperature resistant material and providing a fluid flow passage for circulating a cooling fluid therethrough.

In what follows, the various parts of the system will be discussed in order beginning with the overall arrangement of the system including the arrangement of the individual coils to form the main coil and the interconnection of these with a current balancing system, the theory of the current balancing system and the construction of the special low loss conductors for the liquid-cooled type of induction device and the use of a heat sink winding to control the thermal gradient across the refractory and to protect the coil winding from the heat flux of the load.

LIST OF DRAWINGS

The invention is illustrated by way of example in the accompanying drawings wherein.

GENERAL ARRANGEMENT OF SUBCOILS TO FORM MAIN INDUCTION COIL

Figure 1:
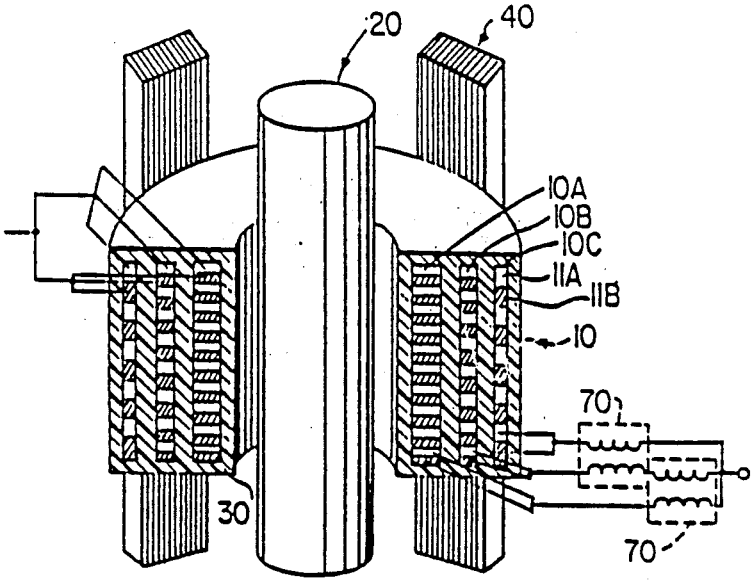
FIG. 1 is an oblique partial sectional view of the coil portion in an induction heating apparatus provided in accordance with the present invention.

FIG. 1 shows, in partial cross section, a part of the physical portion of an induction heating apparatus which includes a rigid, cylindrical, induction coil unit 10, provided in accordance with the present invention, with a central billet 20 to be heated thereby. The induction coil unit 10 comprises co-axially disposal coil layers designated respectively, 10A, 10B and 10C embedded in a set rigid resinous material (epoxy) 30. While 3 layers are shown spaced for clarity in illustrations but normally wound tightly upon one another, there may be only 2 or more than 3 if desired. Each coil layer, when there are two or more, may consist of a single winding or two or more identical helical windings wound simultaneously whereby the conductors e.g. 11A, 11B, are interleaved.

The conductors 11A and 11B are co-axial with equal radic and thus have their turns between one another i.e. interleaved. Special low loss conductors described hereinafter, are preferrably used. When there is only one coil layer (and also if desired when there are a number of layers) there are two or more interwoven identical helical windings all having the same inside and outside diameter and the same number of turns. The manner of terminating the ends of these individual helices will be discussed hereinafter.

In FIG. 1 each coil layer 10A, 10B, etc. is shown as containing two interwoven helices, but any number of interwoven helices may be used in any layer and each coil unit may have any number of layers. The coil layer (or layers as the case maybe) are embedded in a glass fibre reinforced epoxy 30 thereby providing a rigid coil unit. The billet 20 (which could be solid or liquid, non-magnetic or magnetic and an arbitrary length) is conducting and a number of laminated magnetic steel yokes 40, located radially outside of the coil unit are provided to carry the return flux outside the coil. This prevents such flux from inducing unwanted eddy currents in surrounding structures and in some installations such yokes may not be required.

Figure 2:
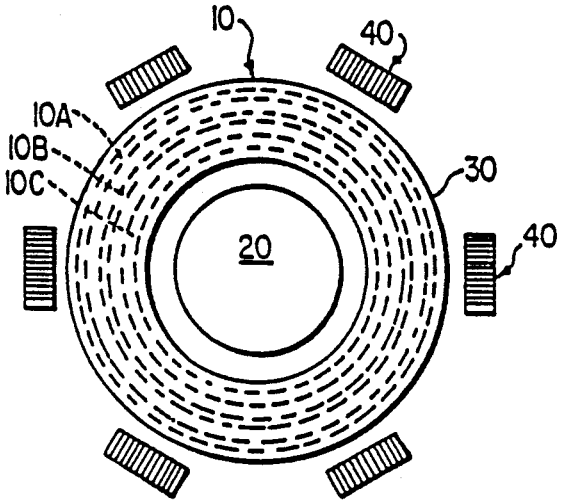
FIG. 2 is a top plan view of FIG. 1.

The coil unit 10, of FIGS. 1 and 2 comprises 6 separate, magnetically coupled coils i.e. 2 helical windings in each of layers 10A, 10B and 10C. It is now required to connect these coils electrically in parallel in such a manner that each of the coils will carry a pre-determined share of the overall current despite the presence or absence of the billet, despite the frequency of the supply to which the coils are connected and despite the presence or absence of the yokes. This goal may be achieved by a judicious choice of the number of turns used in the various layers in conjunction with a current balancing system which will be described hereinafter.

When yokes 40 are present (they are required when 3 or more high windings are used), advantage may be taken of their presence to produce partial turns. The ability to produce partial turns presents an auxiliary way of achieving nearly perfect current balance among the interwoven identical helices within a layer and at the same time to produce nearly perfect grading between adjacent conductors in the package throughout the length of the coil winding. This has the result of reducing the voltage stress between adjacent conductors to approximately 1/n where "n" is the number of interwoven helices in a layer.

THE USE OF YOKES TO PRODUCE PARTIAL TURNS AND CURRENT BALANCING

Figure 3:
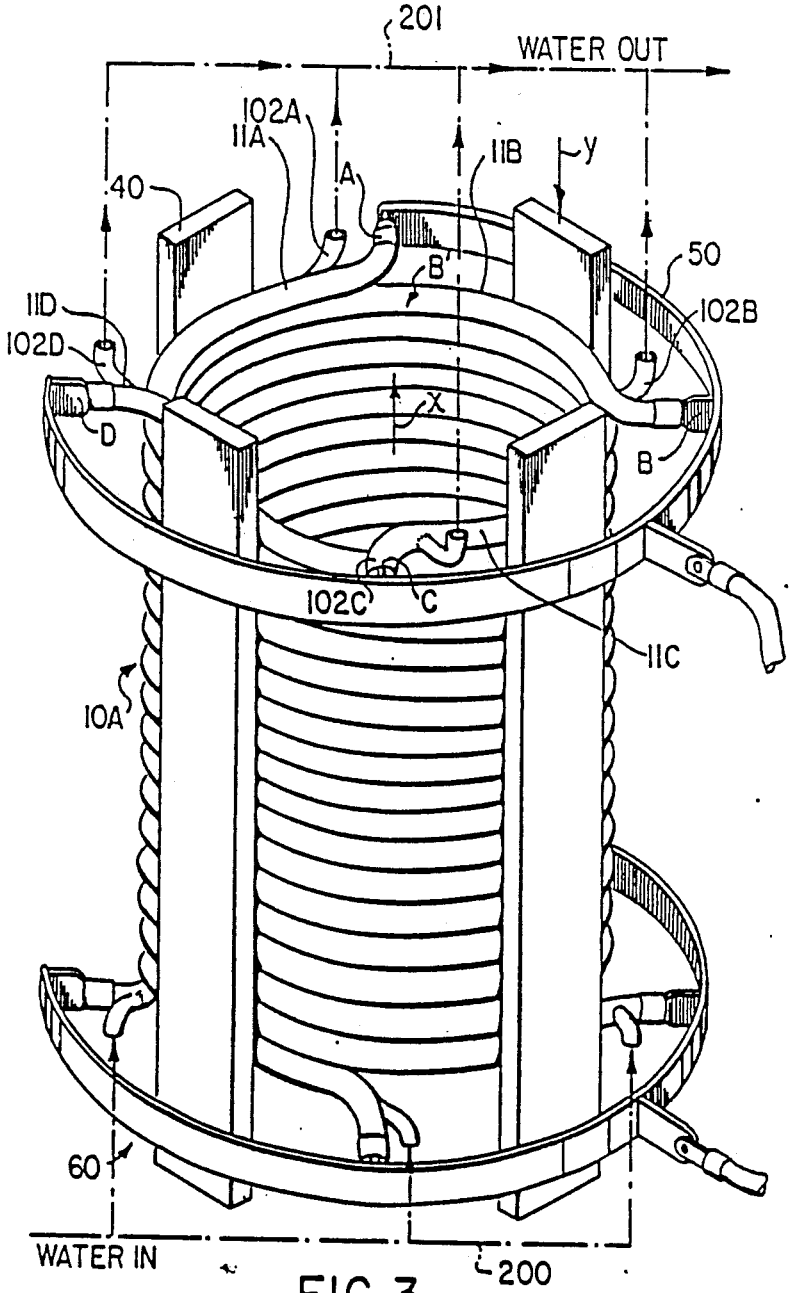
FIG. 3 is an oblique partial schematic view of an induction heating coil of the present invention.

FIG. 3 diagramatically illustrates a single layer coil, i.e. 10A, but with four interleaved helical windings instead of only two as illustrated in FIG. 1 in each of the 3 layers. The four interleaved windings are designated 11A, 11B, 11C and 11D around which are symetrically situated four steel yokes 40. The four coil windings 11A, 11B, 11C and 11D are connected in parallel at the top end via a partial or split ring bus 50, which runs outside the yokes. The four coil windings 11A, 11B, 11C and 11D spiral downward in a counterclockwise direction where they terminate at different circumferential positions on the coil i.e. 90° from one another and are connected via a second partial or split ring bus 60 to an output line. Coil winding 11A is shown with the top end start of the winding designated as A. Coil windings 11B, 11C and 11D are shown with the top end start of the windings designated B, C and D respectively. The four interwoven coil windings thus carry counterclockwise currents together producing an upward flux in the coil as shown schematically by the arrow X. This flux is captured by the four yokes which each carry one-fourth of the total flux downward as shown schematically by the arrow Y. For the moment, the leakage flux which moves downward outside or between the yokes will be ignored. Ignoring this leakage flux, and assuming a low resistance winding, then points A, B, C and D, corresponding to the beginings of the four interwoven windings, are at the same potential. Now point B' which is on the same winding as point B but a quarter turn later, is at a different potential than point B due to the induced voltage caused by the inner flux over the quarter turn distance. In fact, point B is at a potential which is one quarter of the voltage per turn higher than point B'. Therefore, the potential difference between points A and B' is only a quarter of the turn-to-turn voltage which would result in a single layer coil occupying the same space as the four interwoven windings and containing the same number of turns as each of the interwoven windings. A similar argument may be used to show that the conductor to conductor potential difference all the way down the length of the four interwoven windings will be exactly one-quarter as large as it would be if only a single winding had been used (having four times the pitch) having the same number of turns as each of the interwoven windings. Similarly, if n windings were interwoven at the same time and all fed from a ring type bus symmetrically between the n yokes, then the resulting conductor-to-conductor voltage all the way down the length of the layer would be exactly 1/n of the turn-to-turn voltage which would result if a single winding had been used occupying the same length and having the same number of turns as each of the interwoven windings (and having n times the pitch). Thus, the use of a ring bus supply outside the yokes allows the designer to grade the voltage applied to a coil as shown. It is also apparent that, if the termination of n windings at the bottom is also achieved by a ring bus, and furthermore each of the n windings has exactly the same number of turns, then the current in the n interwoven helices must all be identical since each coil winding links with precisely the same flux due to the symmetry with which they are wound. Furthermore, if a circular billet is introduced along the centreline of the coil it will not disturb the symmetry of the n windings, which are all affected in the same manner. Therefore, the n windings will continue to carry equal currents and the voltage between adjacent conductors along the length of the layer will continue to be graded. It should also be apparent that a change in frequency of the supply to the coil will not change either the nearly perfect current balance or the voltage grading. A change in frequency of the supply and/or the introduction of a billet will of course change the effective impedance of the coil, and of each of the interwoven helices and, therefore, the ratio of voltage to current.

If the yokes do not capture all of the coil flux, and part of it returns outside the ring bus, then the current balancing and voltage grading will not be perfect. The departure from perfection will be proportional to the percentage of the flux, which escapes the yokes.

It should also be apparent from the above discussion that the use, in a multilayer coil, of yokes and the ring bus supply described above will permit the use of partial turns in each coil layer to an increment of 1/n of a turn in the case where each coil layer has n interleaved windings.

CURRENT BALANCING SYSTEM

Figure 4:
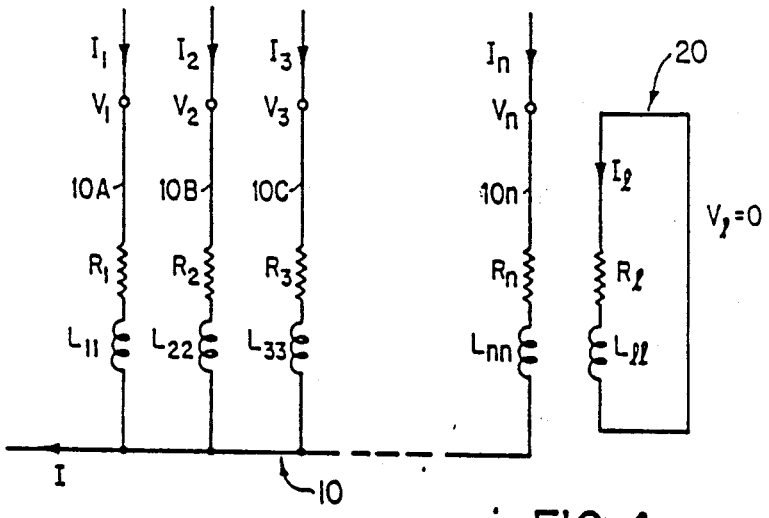
FIG. 4 is an electrical schematic of the apparatus of FIGS. 1 and 2.

Although the system described in the preceding section allows for obtaining current balance within the interwoven helices of a layer, it will not suffice to balance the currents between coaxial radially spaced coil layers, especially under varying conditions such as load or frequency change. The system to be described in this section is used to achieve current balance in multi-layer coaxially disposed wound coils or single layer interwoven helices for the case when yokes are not present. The equivalent circuit of an induction heating coil like that shown in FIG. 1, but where the number of layers and the number of interwoven helices per layer is arbitrary, may be represented as shown in FIG. 4. In this figure the coil layers are designed 10A, 10B, 10C. . . 10*n* with the layer n representing the last in any number of layers, and, for the sake of clarity, it is assumed that there is only one helix per layer. The inductances shown represent the self-inductances of the individual windings comprising the overall coil and it is to be understood that all such inductances are mutually coupled. The coil layers have designate thereon current I, voltage V, Resistance R and inductance L with appropriate subscripts for the respective different coil layers. If we now assume that a given sinusoidal current is injected into each of the layers, then the coupled circuit equations for the situation are shown in two equivalent forms as equation 1:

$$(R_1 + jwL_1)\,I_1 + jwL_{12}I_2 + \ldots jwL_{1n}I_n + jwL_1\,I = V_1$$

$$jwL_{12}I_1 + (R_2 + jwL_{22})\,I_2 + \ldots + jwL_{2n}I_n + jwL_2\,I = V_2$$

$$\vdots$$

$$jwL_{1n}I_1 + jwL_{2n}I_2 + \ldots + (R_n + jwL_{nn})\,I_n + jwL_n\,I = V_n$$

$$jwL_1\,I_1 + jwL_2\,I_2 + \ldots + jwL_n\,I_n + (R + jwL)I = O$$

and equation 2:

$$R_1I_1 + jw_1 = V_1$$

$$R_2I_2 + jw_2 = V_2$$

$$\vdots$$

Figure 5:
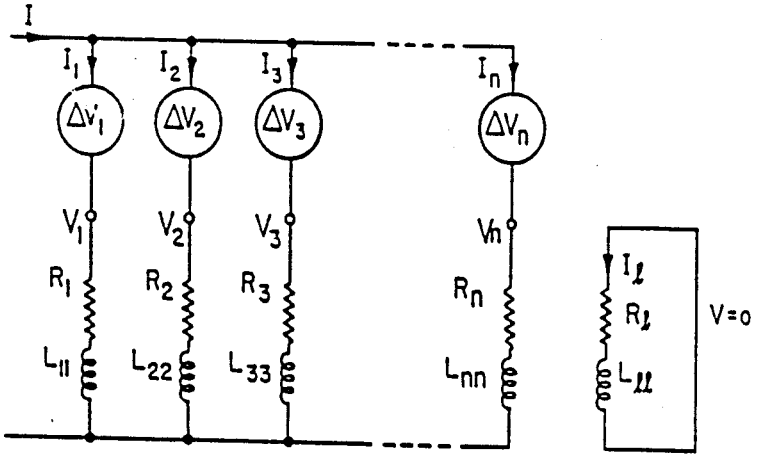
FIG. 5 is similar to FIG. 4 but with all of the coil layers in parallel.

-continued $$R_n I_n + j w_n = V_n$$
$$R I + j w = O$$

where $L_{kk}$ represents a self-inductance of winding k, $L_{ij}$ represents a mutual inductance between windings i and j, $L_j$ represents the mutual inductance between the billet 20 and winding j, and where $R_n$ represents the resistance of winding n, and R represents the equivalent resistance of the billet. In equation 2 the symbol, with a subscript, re presents the total flux linking the subscripted winding. As may be seen in FIG. 4 the bottom of all windings are connected in common. Since the current in each layer has been forced to have an arbitrary value, it is readily apparent that the voltage drops across each winding, shown as $V_j$, will not, in general, be equal. Therefore, if the upper terminals of each of the separate windings are all connected together, that is, if the layers are forced to have a common voltage, then it is clear that the currents will not maintain the values originally imposed. Now, if additional voltages V of the appropriate magnitude and phase are injected into each of the windings (see FIG. 5) then all of the terminal voltages can be made equal. If the separate windings were now connected in parallel, the voltages will be the same and the currents will not change from their initial values.

Figure 6:
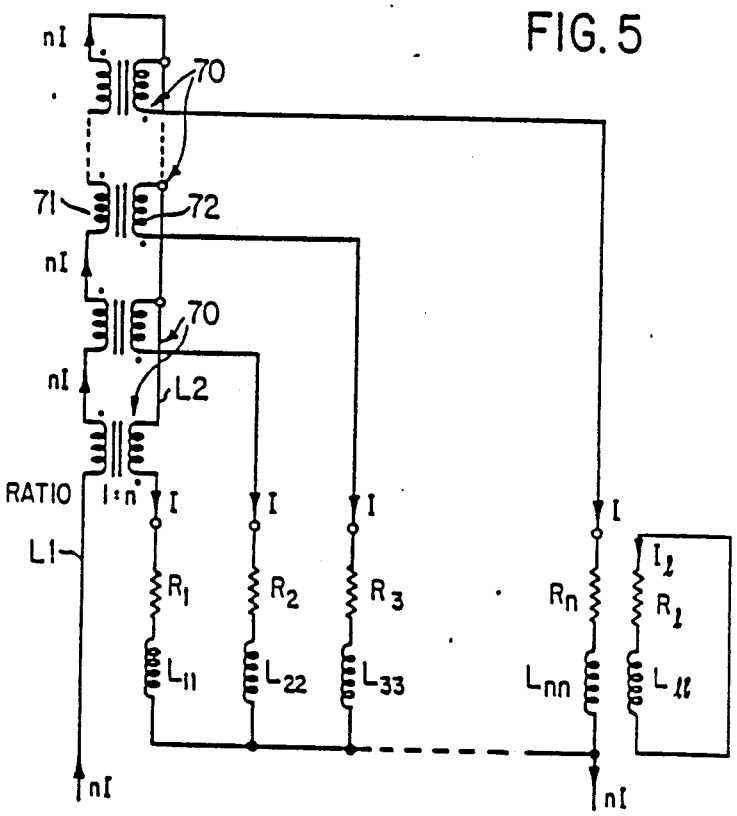
FIG. 6 is an electrical schematic of the apparatus of FIG. 1 with current balancing means for the paralleled layers of coils.

The required voltages may be injected into the various windings by the use of transformers 70 shown in FIGS. 1 and 6. Assume for simplicity that it is required to have identical currents in each of the layers, the primaries 71 of n identical transformers are connected in series with one line $L_1$ as shown, for example in FIG. 6. The secondary 72 of each of the transformers is connected in series with one of the layers 10A, 10B, 10C, etc., associated therewith, the other end of the secondaries being connected in common as shown by line $L_2$ and the common point connected in series with the primaries. The turns ratio of each transformer is 1:n, that is, the secondaries have n times as many turns as the primaries. If we assume for the moment that the transformers are ideal, then the current in the secondary of each transformer must be exactly 1/n times the current in the primary, that is, the current in all of the windings are forced to be the same regardless of whether there was an initial imbalance or not. The current balance occurs because a voltage appears across the terminals of each of the secondaries which is precisely of the right magnitude and phase to make the total voltage across each winding and its transformer exactly the same as that across each of the other windings and its transformer.

The voltages appearing on the secondaries cause voltages across the primaries of all the transformers which are smaller by exactly the transformer ratio. It is apparent that the voltages across some of the transformers will be positive and across others will be negative as required to make all winding voltages average out to the same value.

In real life the transformers are not ideal and the flux in the core of each transformer requires an exciting current. As is the case in all transformers this exciting current is negligibly small as long as the cores are not driven into saturation. This illustrates an important design criterion for the transformers. They must be designed to carry sufficient flux to give rise to the voltages they are required to produce. In designing the transformers it is necessary, therefore, to known an upper bound on the value of the incremental voltage required to be produced by each transformer but the polarity need not be known. The other design criteria for the transformers is that the winding have sufficient cross-section to carry the rated currents of the windings. A cascade transformer wound from water cooled conductor has been found to perform satisfactorily.

Figure 7:
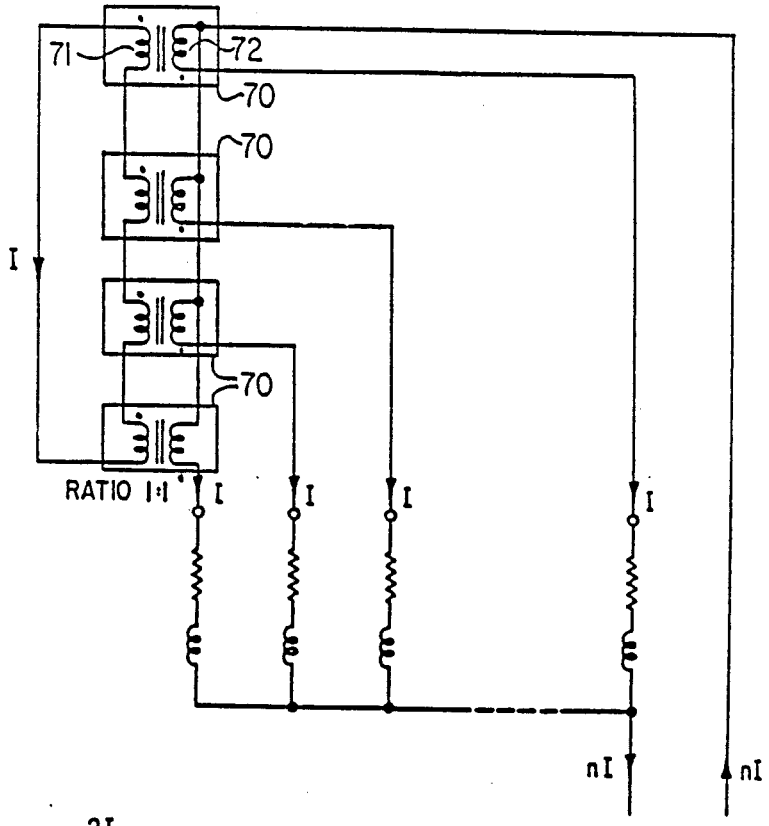
FIGS. 7, 8 and 9 are electrical schematics illustrating variations of the current balancing.
Figure 8:
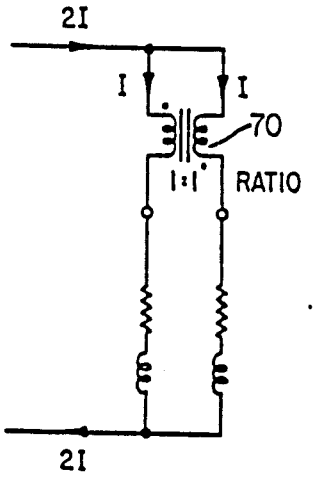
Figure 9:
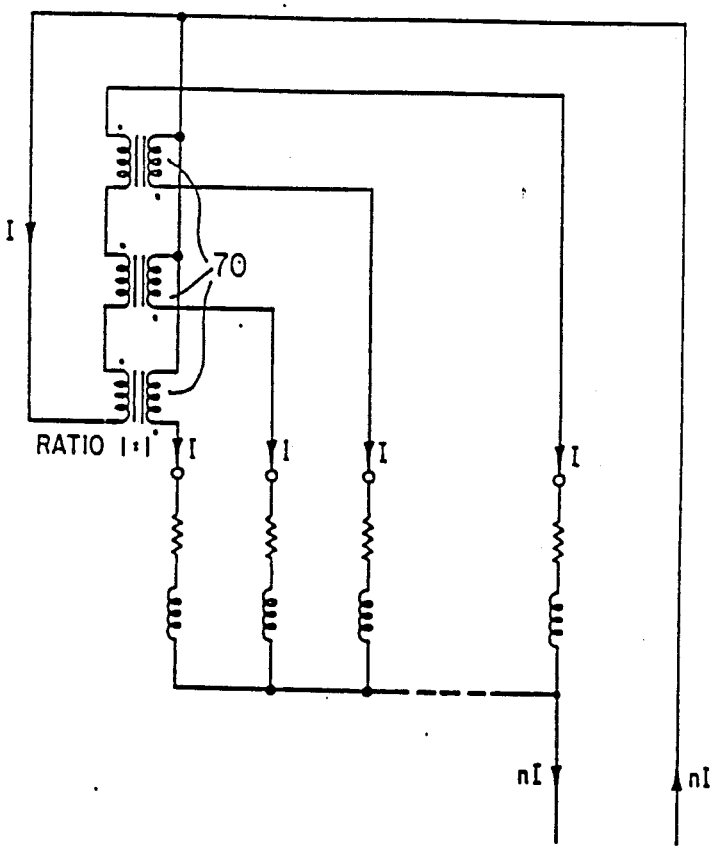

Three other embodiments of the balancing are shown in FIGS. 7, 8 and 9. In FIG. 7 all of the transformers 70 have a ratio 1:1 and, as may be seen, all of the primary windings 71 are connected in series in a ring. This circuit behaves exactly the same as that shown in FIG. 6 and has the obvious advantage that the primary and the secondary windings are identical.

FIG. 8 shows the simplest embodiment of this invention. A single transformer 70 is shown being used to balance the current in a two winding device. FIG. 9 shows a scheme using n−1 transformers 70 to balance the currents in an n winding system. In this scheme one of the windings is chosen as the reference winding and is connected in series with all of the primaries. This has an obvious advantage over the circuits shown in FIG. 6 and 7 of requiring one less transformer.

It should be obvious that one need not have all currents equal in the windings. One may obtain a different current in each winding simply by choosing an appropriate ratio for the particular transformer in that winding.

USE OF CURRENT BALANCING SYSTEM AND SPIDER TO PRODUCE CURRENT BALANCING AND VOLTAGE GRADING SIMULTANEOUSLY IN A REACTOR WITHOUT YOKES

It is well known that voltage grading can be produced among a group of interleaved helices in a single layer even when connected in parallel provided that spiders are used at both ends. (See for example Pat. No. 3,264,590). The use of spiders to produce both current balancing and voltage grading allows the designer considerably more freedom in his choice of conductor sizes and arrangement in order to achieve an optimum design for a reactor.

Figure 10:
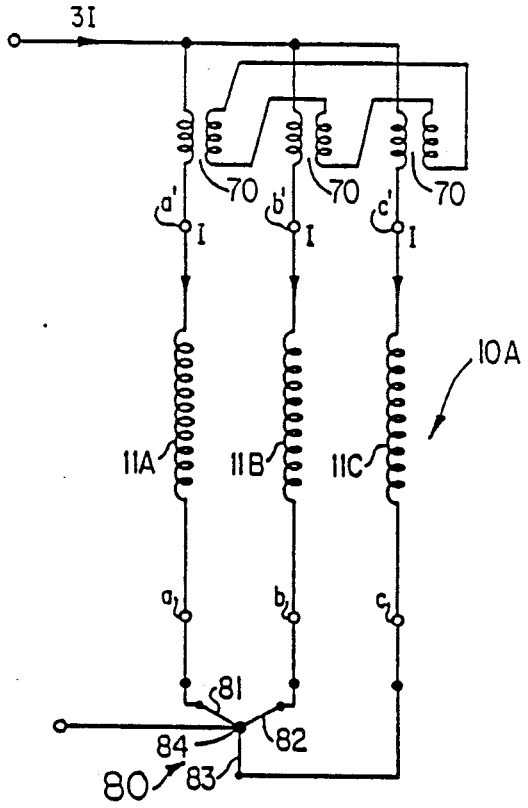
FIG. 10 is an electrical schematic illustrating voltage grading in addition to current balancing in an induction heating inductor without use of yokes or spiders.

FIG. 10 shows the circuit diagram corresponding to a single layer coil, for example 10A, comprising three interleaved identical windings 11A, 11B and 11C in which the current balancing uses transformers 70, as described previously and a spider 80 for voltage grading. The spider 80 has 3 arms, 81, 82 and 83 radiating outwardly from a central hub 84.

If a spider were provided at the top, the three interleaved identical windings could be terminated at points 120 degrees apart and the three windings would have identical numbers of turns and would enclose exactly the same total flux. Therefore, they would carry identical currents and the voltage would be continuously graded between conductors from top to bottom of the interleaved windings. However, it is impossible to use a spider at the top since the top must be open to allow the metallic load to be moved in and out, and thus a set of current balancing transformers 70 are included as shown in FIG. 10. This automatically forces the currents in the three interleaved windings to be identical under all conditions of load and frequency and also forces the settings to be graded uniformly between all adjacent inductors along the length of the three interleaved windings.

A preferred embodiment of the overall induction heating system comprises a multi-layer coil in which the individual layers comprise interwoven helical windings, in which the conductors are of a special low loss kind as described hereinafter, where the overall current balance among windings in different layers is maintained by the current balancing system described above, where the current balancing among the interwoven helices of a single layer is maintained either by the current balancing system or by the novel split ring bus system in conjunction with the yokes described above, and lastly, where voltage grading among interwoven helices of a single layer is provided either by the novel split ring bus system described above when yokes are present or by the use of a spider in conjunction with the current balancing system as described above when yokes are not present.

LOW LOSS CABLES FOR LIQUID-COOLED COILS

Figure 11:
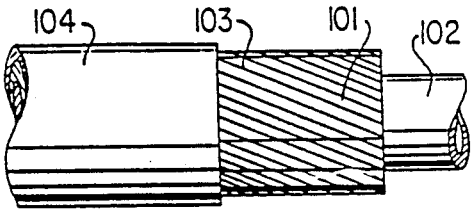
FIGS. 11 to 16 are views illustrating low loss conductors for the induction heating inductor of the present invention.
Figure 11A:
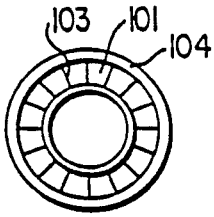

A low loss conductor with a central conduit for liquid cooling is shown in FIGS. 11 and 11A, and comprises a plurality of electrical subconductors 101 (of solid cross section and either circular or trapezoidal in cross sectional shape) cabled in unilay spiral fashion around a hollow, generally circular in cross-section, cooling tube 102, through which a fluid or liquid coolant such as water, may be circulated. The subconductors 101 are generally metallic and preferably copper or aluminum. The thermal and electrical properties of the cooling tube 102 are critical to the proper operation of induction coil in which the cable is used. On the one hand, the thermal conductivity must be sufficiently large to transfer the $I^2R$ losses and eddy losses in the strands under maximum current conditions to the fluid flowing through the cooling tube. On the other hand the electrical conductivity must be sufficiently small to keep the eddy current losses in the cooling tube small. The acceptable levels of the thermal conductivities and electrical conductivities is a complex function of the conductor geometry, the coil geometry, the frequency of the current and the current density in the conductor. However, the levels can be readily established by one knowledgeable in the art. For line frequency operation of even large reactors #304 stainless steel has acceptable properties. For 10 kHz coils, Teflon* has been found to work well. For intermediate frequencies composite cooling tubes, eg. glass-fibre reinforced, carbon-fibre reinforced, or, stainless steel reinforced plastic appear to be suitable.

The subconductors 101 are electrically insulated from each other by a coating 103 and the fact that they are cabled in spiral fashion around the cooling tube 102 effectively continuously transposes them so that they share the total current equally. The entire assembly may be coated with an exterior coating layer 104, which acts as an insulation layer and also as a protection against physical damage or abrasion. Coating layer 104 may be applied by winding a filament material or by extruding an insulating thermoplastic or thermosetting material over the assembly.

Figure 12:
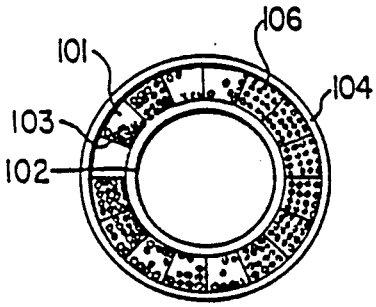

In certain applications, the apparatus size and/or configuration and the frequency of operation may mean that even with an arrangement of subconductors 101 as described hereinabove, the eddy losses in the subconductors are unacceptably large. In such circumstances the subconductors 101 may themselves be subdivided into smaller sub-subconductors 106 as shown in FIG. 12. The number and size of the sub-subconductors may be selected to make the eddy current losses as low as is required, within practical limits. The sub-subconductors 106 may be transposed by bunch cabling or be regular cabling and then by roll forming into trapezoidal segmental shapes either before they are wound over the cooling tube 102 or while they are being wound over the cooling tube 102.

Figure 13:
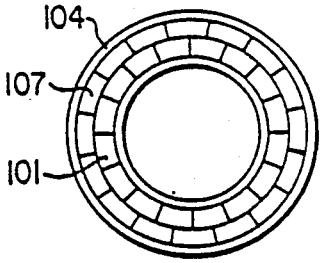

In an alternative embodiment, illustrated in FIG. 13, a second layer of subconductors 107, is cabled over the first layer before the insulating material 104 is applied. The subconductors in both layers are insulated individually and these subconductors may be further subdivided into insulated strands, as explained above, to further reduced eddy losses.

Figure 11B:
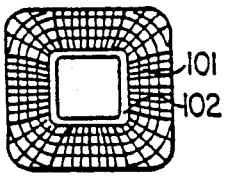
Figure 11C:
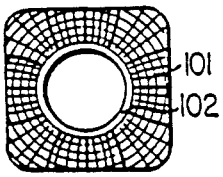

In order to increase the winding factor of the coil, the cable may be made approximately rectangular in cross section as shown in FIG. 11B) by winding the conductors 101 over a cooling tube 102 of rectangular cross section. Alternatively, as shown in FIG. 11C), the conductors 101 may be wound over a circular cooling tube 102 and the resulting cable roll-formed to have a rectangular cross section.

Figure 14:
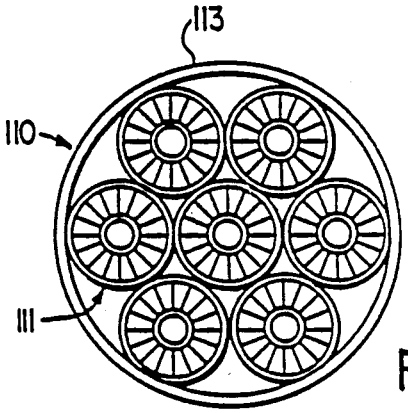

A further, more complex embodiment is illustrated in FIG. 14, and shows a composite cable 110 comprising seven subcables 111 each of which is fabricated as in FIGS. 11, 12 or 13. The composite cable 110 is formed by spiralling six outer subcables, in the conventional way of making cables. The entire assembly may be insulated with a layer 113 of insulating material as hereinbefore described. Where the layer of insulation 113 is used, the layer 104 about each of the subcables may be omitted as each of the subconductors is covered with an insulating layer and consequently layer 104 may be redundant. In order to achieve a better space factor, the subcables 111 may be roll formed to have a segmental cross-section.

Figure 15:
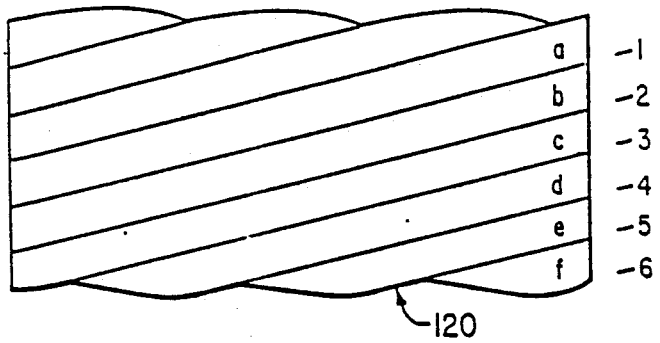
Figure 16:
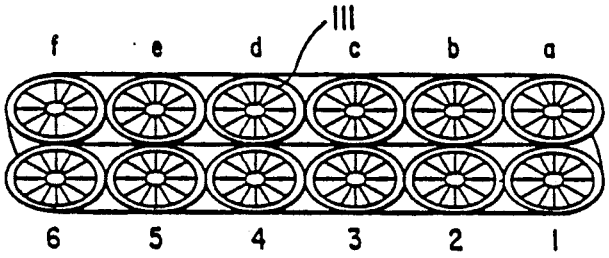

An alternative form of a composite cable such as that of FIG. 14 is shown in FIGS. 15 and 16. A large flat cable 120, comprising a plurality of subcables 111 (FIG. 14) continuously transposed around the cable without the use of a central core cable, is illustrated. The cable 120 is roll or otherwise formed, after cabling to provide the flat shape as seen in end view in FIG. 16. This form of continuous transposition provides an improved space factor and very low eddy losses and can be produced by cabling the subcables 111 around a mandril and withdrawn the composite wound cable from the mandril during winding.

In all of the conductors described in this section, a thermal setting bond-coat may be applied to the substrands to cause them to adhere to each other to form a vibration-free winding.

While references to liquid and more particularly water cooling has been made, it will be appreciated that the principles thereof are equally applicable to vapour gaseous fluid cooling using such fluids as FREON gas as commonly used in refrigeration systems and the like. In installations where fluid or liquid cooling is not required the coil units of FIGS. 1 or 3 are preferably wound using the conductor of FIG. 12 wherein the conduit 102 is designated A, B, C or D, as the case may be, for the respective helical windings. In FIG. 3 water inflows through inlet header 200 and outflows via outlet header 201.

ARRANGEMENT OF INDUCTION HEATING SYSTEM

In the foregoing there is described a coil arrangement in and for electrical induction heating apparatus. In the simplest form the coil is a single cylindrical coil i.e. one layer with two or more coil layers each being a single helical winding preferably using the conductor of FIG. 12. Electrically the windings are connected in parallel. As previously mentioned, any number of coil windings can be used. The two windings in FIG. 1 designated 11A and 11B are interleaved helical windings one defining a coil layer designated, for example, 10C. Additional coil layers may be used with all such layers being coaxial and preferrably of the same axial length. A single coil unit may consist of one or more layers embedded in a glass reinforced resin providing rigidity to the unit.

In the case of winding coils from a hollow conductor for liquid cooling, eg. the conductors illustrated in FIGS. 11 to 16, the coil layers 10A, 10B, 10C can be wound tightly on one another without any radial spacing therebetween. This provides a very rigid structure with close coupling of the coils.

The number of turns of the coils winding are designed to balance the coils as closely as possible so as to minimize circulating currents in the parallel connected coils even in the absence of a current balancing system. Fine tuning of the balancing and balancing under varying load conditions is effected by the previously described arrangement of balancing transformers.

As previously explained, the heat generated by the $I^2R$ loss of the conductors is removed by cooling tubes running down the centre of the special water-cooled conductors. It is also required to remove the heat flux which flows from the hot billet (or melt) out through the refractory between the billet or metal and the coil to control the thermal gradient across the refractory. In the conventional designs this heat flux is removed by the hollow copper winding conductors themselves. For small heat fluxes, the special water-cooled cables can absorb the heat without damaging the conductor 101 around the cooling tube 102. To deal with heat fluxes a heat sink is provided around the outer surface of the refractory and inside the inductor coil.

Figure 17:
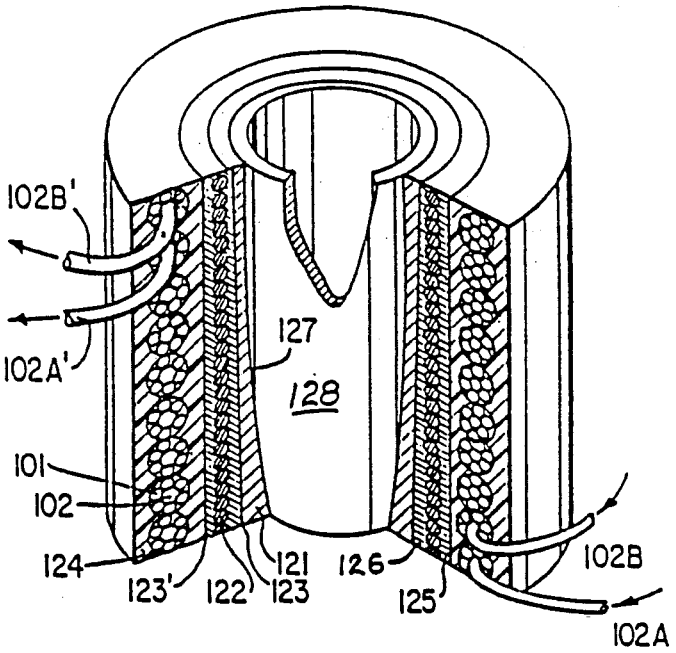
FIG. 17 is a partial oblique view in partial section of an induction heating coil and heat sink winding of the present invention.

FIG. 17 in partial cut away illustrates a heat sink winding 122 between the refractory 121 and the induction heating coil unit 10. The heat sink comprises either a single helical coil winding or several interwoven helices all in a single layer but isolated from each other and from the main coil. The heat sink coil is a spiral winding of a hollow tube the size and material being chosen to give good heat transfer characteristics and to have small eddy losses. Suitable for this is a tube made of #304 stainless steel. The heat sink winding carries cooling fluid but no current. The heat sink winding is a separate rigid unit tapered for easy removal from the main coil. The heat sink tube is encapsulated in suitable heat resistant material 123, for example, an epoxy resin. The induction coil 10 is encapsulated in an epoxy material 124. The juncture 125 between the induction coil unit 10 and the encapsulated heat sink unit is a tapered truncated cone facilitating removal and replacement of the heat sink unit or coil winding unit as may be required. Also the juncture 126 between the refractory 121 and heat sink unit 123 is also a truncated cone and the juncture 127 between the refractory and crucible 128 is also a truncated cone. The coil 10 is shown as having two interwoven helices 11A and 11B each wound from the conductor shown in FIG. 12. Cooling water flows in as indicated at 102A and 102B and out at 102A' and 102B'. If desired the heat sink tubes can be coupled together in which case water flows in at one of 102A or 102B and out of the other. While the preferred form of heat sink has been described i.e. a tube helically wound other tube arrangements may be used to carry the cooling fluid along a path between the refractory and the induction coil unit. For example, a multiplicity of tubes can extend parallel to the coil axis and have opposite ends thereof connected to respective ones of an inlet and outlet header. This however, is costly to make.

The term heat sink is used herein to describe in simple terms some means of preventing radiant heat from the billet from reaching in damaging portions the inductor coil. The heat sink could be thought of in terms of being a heat barrier or heat shield. The heat sink winding with cooling water flowing therethrough functions as a heat exchanger absorbing and removing heat radiated from the billet to the extend such heat does not rach and destroy the insulation on the conductors of the inductive coils and/or resin encapsulating the coil.

Since the main coil flux induces electromotive forces in the heat sink winding, the number of turns used and the number of interwoven helices can be chosen to grade the voltage along the heat sink winding so that there is virtually no electrical stress between it and the coil windings. This can be achieved by using approximately the same number of turns and the same number of interwoven helices as are used in the innermost layer of the coil.

The benefits of constructing induction heating coils according to the methods disclosed herein are illustrated by Tables 1 and 2 below. Table 1 describes four coils which were built and tested: coils A and B were built as single layer coils from hollow copper conductors in the conventional manner and coils AA and BB which were built for the same service but according to the methods disclosed herein. Both of the high efficiency coils AA and BB comprised two layers of the special conductors described herein and a current balancing scheme like that shown in FIG. 8 was used to insure that the currents in the two layers were equal.

Table 2 compares the energy transfer efficiency of the conventional coils A and B and of the coils AA and BB built according to this disclosure for the case where comparable coils were used at the same frequency and where they were required to deliver the same power to the billet. The actual energy transfer efficiency was measured at room temperature 20° C., and the results for these tests are shown. The results were also extrapolated to the case of molten AL at 750° C. This was done by using a value for the resistivity of molten AL of $28\times10^{-8}$ ohm meters. The performance of coils A and AA are compared only at the design frequency of 4 kHz while the behaviour of coils B and BB are compared both at the design frequency of 1 kHz and also at 3 kHz.

The superiority of the coils built according to present invention is apparent. Coil losses in each case are only a small fraction of the coils losses in the conventional coils and the energy transfer efficiency is accordingly very much higher. It was not possible to compare either of these coils directly with coils of the type advocated by I. A. Harvey and by M. Coevert et al, which are referred to in the section "BACKGROUND OF INVENTION". The coils built according to these methods, according to the authors, are not useful beyond about 400 Hz. The power transfer efficiency using these coils at the frequencies indicated in Table 2 would probably be comparable to that of the conventional coils A and B. Coevert et al claimed an efficiency for their coil when heating aluminum at 50 Hz of 54%. By comparison, a three layer coil built according to this disclosure achieved an efficiency of 70%.

The rigid coil unit described in the foregoing is self supporting in that loads imposed thereon by energizing the coil are withstood by the coil unit itself without the need of any other support structure. These electrical loads are quite substantial. The rigid coil unit is also extremely quiet in operation compared to inductor coils presently used in induction heating systems where the coil windings subrate from the imposed electrical loads the noise level from such being as high as 125 db. Not only is applicants coil self supporting but if need be it can provide some support for the refractory, crucible, molten metal, etc.

TABLE 1

| | | COIL AND BILLET SPECIFICATIONS | | | | | | | |
|---|---|---|---|---|---|---|---|---|---|
| | | COIL | | | | | BILLET | | |
| IDENT | # TURNS | LENGTH IN | ID IN | OD IN | # LAYERS | CONDUCTOR | LENGTH IN | DIA. IN | MTL |
| A | 17 | 15 | 15 | 16 | 1 | ¼" COPPER TUBE, 0.08 WALL | 15 | 10.75 | Al |
| AA | 16 | 15.5 | 16 | 20 | 2 | 8 × 5 × 80 #30 COPPER OVER ¼" NYLON | 15 | 10.75 | Al |
| B | 28 | 42 | 30 | 32 | 1 | " COPPER TUBE, 0.12" WALL | 42 | 25 | Al |
| BB | 24 | 42 | 30 | 35 | 2 | 8 × 5 × 80 #30 COPPER OVER ¼" NYLON TUBE, WOUND 2-HIGH | 42 | 25 | Al |

TABLE 2

| | | ENERGY TRANSFER EFFICIENCY | | | | |
|---|---|---|---|---|---|---|
| COIL IDENT | FREQ. kHz | CURRENT A | BILLET TEMP °C. | BILLET POWER kW | COIL $I^2R$ kW | EFF % |
| A | 4 | 1500 | 20 | 21.8 | 41.8 | 34.3 |
| AA | 4 | 1790 | 20 | 21.8 | 9.0 | 70.7 |
| A | 4 | 1500 | 750* | 65. | 41.8 | 61. |
| AA | 4 | 1790 | 750* | 65. | 9.0 | 88. |
| B | 1 | 2700 | 20 | 95. | 98.0 | 49. |
| BB | 1 | 2700 | 20 | 95. | 22. | 81. |
| B | 1 | 2700 | 750* | 285. | 98. | 74. |
| BB | 1 | 2700 | 750* | 285. | 22. | 93 |
| B | 3 | 2700 | 750* | 490. | 164. | 75. |
| BB | 3 | 2700 | 750* | 490. | 24. | 95 |

*ASSUMES RESISTIVITY = 28 × $10^{-6}$ ohm-m average

I claim:

1. In electric inductive heating apparatus an improved inductive coil comprising a rigid open ended sleeve-like coil unit that includes two or more co-axial, co-extensive helical coil windings embedded in a temperature resistant, reinforced resin, each of said coil windings comprising a plurality of helical turns of multi-strand insulated conductor, means for connecting said coil windings in parallel and current balancing means operative in response to current flow respective ones of said coil windings thereby automatically forcing said coil windings to maintain a selected predetermined share of current flow including during variations of load and/or frequency.

2. The improvement of defined in claim 1 wherein said coil windings are interleaved such that the helices are one on top of the other forming a single layer coil.

3. The improvement as defined in claim 2 including a plurality of yokes spaced apart from one another circumferentially about said rigid coil unit.

4. The improvement as defined in claim 3 including a split ring surrounding a portion of the rigid coil unit and connecting the coil windings in parallel and further including transformer means balancing the current in the coil windings, said transformer means being connected such that current flowing through one winding of the inductive coil flown through a first winding of the transformer means and current flowing through another winding of the inductive coil flows through a second winding of the transformer means and wherein said first and second windings of the transformer means are inductively coupled in a manner whereby the current flow in the coil windings is automatically balanced by feedback through the transformer means.

5. The improvement as defined in claim 1 wherein said coil windings are formed in coil layers radially one outside of the other forming a multiple layer coil.

6. The improvement defined in claim 5 wherein said coil layers each comprise two or more identical interleaved coil windings.

7. The improvement defined in claim 6 wherein said inductive coil comprises at least two concentric layers internested tightly one upon the other and wherein each layer comprises two or more interleaved coil windings and current transformers connected forcing all windings to carry a predetermined portion of the total current regardless of variations of load and/or frequency.

8. The improvement as defined in claim 7 including a plurality of laminated steel yokes disposed in circumferential spaced relation about the rigid coil unit and outwardly therefrom.

9. The improvement as defined in claim 8 wherein current balancing means and voltage grading within a layer are simultaneously provided by connecting the several interleaved windings in each layer to an outer split ring bus at each end of said rigid coil unit.

10. The improvement as defined in claim 6 wherein current balancing means and voltage grading are provided by a combination of external reactors and current balancing transformers.

11. The improvement as defined in claim 6 including the multi-arm spider at one end of said coil unit and wherein the coil windings are connected to arms of said spider thereby connecting the coil windings in parallel.

12. The improvement as defined in claim 1 wherein said coil windings are disposed tightly one upon the other and embedded in a glass fibre reinforced epoxy resin providing a rigid coil unit and wherein said insulated conductor of at least one of said coil windings comprises a plurality of insulated conductors spiralled around the outside of an elongate tube, said tube providing a fluid flow path through said rigid unit for passing a cooling fluid therethrough.

13. The improvement as defined in claim 1 including means for terminating said coil windings at different circumferential positions around said coil unit.

14. The improvement as defined in claim 13 wherein said means connecting said coil windings in parallel comprises a split ring whose diameter exceeds that of the outer diameter of said coil unit and a plurality of laminated steel yokes disposed in circumferential spaced relation about the rigid coil unit and outwardly therefrom.

15. The improvement as defined in claim 13 wherein said means connecting said coil windings in parallel comprises an electrically conductive multi-arm spider located at one end of said rigid coil unit.

16. The improvement as defined in claim 1 wherein said current balancing means comprises transformer means connected such that current flowing through one winding of the inductive coil flows through a first winding of the transformer means and current flowing through another winding of the inductive coil flows through a second winding of the transformer means, said first and second windings of the transformer means being inductively coupled in a manner effective to automatically balance the current in respective ones of said coil windings.

17. The improvement as defined in claim 1 wherein the insulated conductor of said coil windings comprises a plurality of subconductors spiralled about a common axis, thereby being continuously transposed.

18. The improvement as defined in claim 17 including a heat shield comprising a rigid generally cylindrical sleeve like unit removably inserted in said rigid coil unit.

19. The improvement as defined in claim 18 wherein said heat shield unit is a rigid open ended generally cylindrical unit having an outer surface tapered to facilitate insertion of the heat unit into the rigid coil unit and removal therefrom.

20. An improved inductive coil for electric inductive heating apparatus as defined in claim 1 including a heat shield comprising a rigid, generally cylindrical sleeve-like unit removably inserted in said rigid coil unit.

21. The improvement as defined in claim 20 wherein an inner surface of said rigid coil and an outer surface of said heat shield unit mate with one another and wherein such mating surfaces are tapered facilitating separating one from the other.

22. An improved electric induction heating apparatus coil comprising a tabular coil winding that has a plurality of helical turns of a liquid-cooled insulated conductor, said conductor including an inner cooling tube having predetermined heat transfer properties and predetermined eddy losses taking into account coil geometry, frequency and ampere turns for which the coil has been designed and an outer layer of high conductivity insulated strands disposed spirally about such tube, said strands having a diameter to provide selected eddy losses and of sufficient number to carry a predetermined current through said coil winding and a reinforced resin encapsulating said coil winding to form a strong, rigid and vibration free unit in the form of an open-ended cylinder.

23. The improvement defined in claim 22 wherein said coil winding comprises two or more identical, interleaved windings.

24. The improvement as defined in claim 23 wherein current balancing is provided by current balancing transformers.

25. The improvement as defined in claim 23 including a split ring bus at one end of said coil windings connecting said coil windings in parallel and further including a plurality of laminated steel yokes spaced apart from one another circumferentially about the coil unit and located between said split ring bus and rigid coil unit.

26. The improvement as defined in claim 22 including a heat shield comprising a rigid generally cylindrical sleeve-like unit removably inserted in said rigid coil unit.

27. The improvement as defined in claim 26 wherein an inner surface of said rigid coil and an outer surface of said heat shield unit mate with one another and wherein such mating surfaces are tapered facilitating separating one from the other.

28. The improvement as defined in claim 26 wherein said heat shield comprises a plurality of helical turns of tubing embedded in a rigid resinous material.

29. The improvement as defined in claim 26 comprising two or more closely coupled generally cylindrical coil windings embedded in said resinous material and means connecting said windings in parallel.

30. The improvement as defined in claim 29 including current balancing means comprising transformer means connected such that current flowing through the individual coil windings flows through inductively coupled selected coils of the transformer means thereby automatically forcing the individual coils to carry a predetermined share of the current.

31. The improvement as defined in claim 29 wherein said two or more windings are interleaved providing a single layer coil.

32. The improvement as defined in claim 29 wherein said two or more coil windings are radially one outside of the other providing a multiple layer coil.

33. The improvement as defined in claim 32 wherein each coil layer comprises two or more interleaved windings.

34. The improvement as defined in claim 33 including current balancing means comprising transformer means connected such that current flowing through the individual coil windings flows through inductively coupled selected coils of the transformer means thereby automatically forcing the individual coils to carry a predetermined share of the current.

35. The improvement as defined in claim 34 including a plurality of laminated steel yokes disposed in circumferential spaced apart relation about the rigid coil unit.

36. The improvement as defined in claim 35 including a split ring bus at one end of the coil windings and connected to such windings thereby connecting the coil windings in parallel.

37. An induction apparatus comprising two or more cylindrical, closely coupled, multiple turn, co-axial co-extensive coil windings embedded in a rigid resinous material and providing a rigid open-ended generally cylindrical coil unit, means connecting said coil windings in parallel and current balancing means comprising transformers connected to said coil windings such as to provide feed back from one winding to another and thereby automatically forcing all windings to share a predetermined portion of the total current.

38. In electrical induction heating apparatus an improved induction coil comprising a rigid open-ended generally cylindrical unit having at least one sleeve-like coil winding embedded in a rigid set resin material, said sleeve-like coil winding comprising a plurality of helical turns of conductor said conductor consisting of a plurality of insulated multi-strand cabled conductors spirally disposed about the outer surface of a tube.

39. In an electric induction heating apparatus, an induction coil assembly comprising a first rigid open-ended sleeve-like coil unit of at least two coil windings embedded in a glass fibre reinforced resin material, each said coil winding comprising multiple helical turns of conductor comprising a central cooling tube selected to have predetermined heat transfer properties and predetermined eddy losses at the coil geometry chosen and for the frequency and ampere turns for which the coil is designed and an outer layer of high conductivity insulated strands spirally disposed about said cooling tube, the diameter of said strands and the number being so chosen as to provide selected eddy current loss characteristics for a chosen design current and a rigid open-ended sleeve-like heat shield unit removably inserted in said coil unit, said heat shield unit comprising tubular passage means through a rigid heat resistant resinous material for circulating a cooling fluid therethrough.

40. An assembly as defined in claim 39 wherein said tubular passage means comprises a tube helically wound into the form of a cylinder and embedded in a fibre reinforced resin.

41. An assembly as defined in claim 39 wherein mating surfaces of the first and second cylindrical units are tapered to facilitate removal of one from the other.

42. Improvements in induction heating apparatus comprising a rigid generally cylindrical induction coil unit having a helical coil winding of water-cooled conductor encapsulated in glass fibre reinforced resin to form a strong, rigid and vibration free unit; a helically wound heat-shield winding encapsulated in a glass fibre reinforced resin forming a second strong rigid sleeve like unit removably disposed within and concentric with said induction coil unit for facilitating replacement in case of damage, said water-cooled conductor, from which the induction coil is wound, comprising an inner cooling tube around which is spirally disposed an outer layer of high conductivity insulated strands which carry the main induction current of the heating coil, the material of the inner cooling tube having adequate heat transfer properties to remove the heat generated by the current through the outer layer while at the same time having an electrical resistivity which is sufficiently small that the eddy losses induced in the cooling tube will be very small compared to the losses in the main conducting portion of the water-cooled conductor, the diameter of the strands comprising the outer conducting layer providing selected eddy loss characteristics, which depend on the frequency and the field strength required in the coil while predetermined number of strands are provided to carry the current for which the induction coil is designed, said strands being transposed so that each will carry its proper share of the total current, said heat sink winding comprising a tube helically wound into the form of an open ended cylinder and embedded in a fibre reinforced resin.

43. The improvement as defined in claim 42 wherein said coil unit comprises two or more coil windings connected in parallel.

44. The improvement as defined in claim 43 including transformer means connected to said windings forcing each winding to carry a predetermined proportion of the current.

45. The improvement as defined in claim 44 including a plurality of laminated steel yokes disposed in circumferential spaced apart relation about the rigid coil unit.

46. The improvement as defined in calim 45 wherein said means connecting said windings in parallel comprises a split ring bus at one end of said coil windings.

* * * * *